US007012492B2

(12) United States Patent
Mori et al.

(10) Patent No.: US 7,012,492 B2
(45) Date of Patent: Mar. 14, 2006

(54) CONTACT CONSTRUCTION FOR DC LOADS AND SWITCHING DEVICE HAVING THE CONTACT CONSTRUCTION

(75) Inventors: Tetsuya Mori, Shiga-ken (JP); Takuya Yamazaki, Kyoto (JP); Kazuhiro Tsutsui, Nagano-ken (JP); Susumu Sato, Iida (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 10/853,501

(22) Filed: May 25, 2004

(65) Prior Publication Data

US 2004/0239457 A1 Dec. 2, 2004

(30) Foreign Application Priority Data

May 26, 2003 (JP) ..... 2003-147803

(51) Int. Cl.
*H01H 51/22* (2006.01)

(52) U.S. Cl. ..... 335/83; 200/265

(58) Field of Classification Search ..... 335/78–86, 335/124, 128; 200/265–266; 148/131
See application file for complete search history.

(56) References Cited

U.S. PATENT DOCUMENTS 4,050,930 A * 9/1977 Motoyoshi et al. ..... 148/431
4,817,695 A * 4/1989 Wingert et al. ..... 148/431
4,846,901 A * 7/1989 Lima et al. ..... 148/678
5,546,061 A * 8/1996 Okabayashi et al. ..... 335/78
6,831,533 B1 * 12/2004 Sato et al. ..... 335/128

FOREIGN PATENT DOCUMENTS

DE 4024939 * 2/1992
JP 59-70741 * 4/1984

* cited by examiner

*Primary Examiner*—Lincoln Donovan
(74) *Attorney, Agent, or Firm*—Osha Liang LLP

(57) ABSTRACT

A contact construction and switching device for DC loads that can be repeatedly used while minimizing problems such as cut-off failure, locking and deposition due to an abnormal continuation of an arc between the contacts, burning and destruction of the contacts, and an increase in contact resistance has a construction that includes a stationary contact and a movable contact that are opposite to each other, and a magnetic unit which applies a magnetic field orthogonal to the moving direction of the movable contact. In the contact construction, the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO. The switching device has the above-mentioned contact construction.

27 Claims, 2 Drawing Sheets

VIEW SEEN IN DIRECTION I

VIEW SEEN IN DIRECTION II

GENERATION OF ARC

DRIVING OF ARC

COMPLETION OF CUT-OFF

CONTACT CONSTRUCTION FOR DC LOADS AND SWITCHING DEVICE HAVING THE CONTACT CONSTRUCTION

CROSS-REFERENCE TO RELATED APPLICATIONS

This application claims priority from Japanese Application JP2003-147803, filed on May 26, 2003.

BACKGROUND OF THE INVENTION

1. Field of the Invention

The present invention relates to a contact construction for DC loads and a switching device having the contact construction for DC loads.

2. Description of the Related Art

In existing switching devices such as relays having a stationary contact and a movable contact which are opposite to each other, silver-tin oxide-indium oxide-based contacts (hereinafter referred to as the $AgSnO_2In_2O_3$-based contacts), silver-tin oxide-based contacts (hereinafter referred to as the $AgSnO_2$-based contacts), silver-nickel-based contacts (hereinafter referred to as the AgNi-based contacts), silver-zinc oxide-based contacts (hereinafter referred to as AgZnO-based contacts) have been used as contact materials. In general, each of the contact materials is individually used as a contact material common to a movable contact and a stationary contact. In such switching devices, attempts to cope with higher voltages have recently been made. In general, means such as enlarged contact-to-contact gaps are needed to realize switching devices capable of coping with higher voltages, but if switching devices having reduced sizes are to be realized, the contact-to-contact gaps are impossible to enlarge beyond approximately 1 mm. However, if the contact-to-contact gap of a switching device is simply set to approximately 1 mm, an arc remains for a comparatively long time, and if the arc continues to remain for a period of, for example, 100 ms or longer, the problem that cut-off failure occurs in the switching device arises.

Another problem occurring when an arc remains for a long period is that the surfaces of contacts of a switching device are heated to high temperatures so that locking or deposition occurs between the contacts or burning and destruction of the contacts occur to impair the life of the switching device. This problem is particularly remarkable in switching devices of the type which cut off high-capacitance loads. Locking is the phenomenon that a depression and a projection which are formed by the transfer of a contact material from one of the contacts to the other are caught to disable or delay the release of the movable contact from the stationary contact. Deposition is the phenomenon that owing to the melting of the contact surfaces, the movable contact and the stationary contact stick to each other, so that their release is disabled or delayed.

To achieve a long life of the switching device, there are various available methods such as a method of improving the heat resistance of the contacts as by enlarging the contacts and contact parts to which the contacts are secured and increasing the heat capacity of the switching device, a method of enlarging the contact-to-contact gaps to prevent abnormal continuation of an arc, and a method in which release force acting between the contacts is set to a large force so that even if the contacts adhere to each other by deposition, they can be peeled off each other. However, these methods cannot satisfactorily achieve a long life of the switching device, and incur an increase in the size and/or cost of the switching device.

To cope with this problem, it is known to use a method of producing a magnetic field between the contacts by means of a magnetic unit such as a permanent magnet. If a magnetic field is produced between the contacts, a Lorentz force acts on an arc, and the arc is significantly driven (travels) between the contacts in accordance with the Fleming's left hand rule. Accordingly, the concentration of the arc on the surfaces of the contacts is avoided and the arc is easily cut, so that a long life can be achieved.

SUMMARY OF THE INVENTION

However, even the above-mentioned method is incapable of achieving a sufficiently long life of a switching device such as a power relay which cuts off a high-capacitance load of, for example, approximately 42 V DC and 10 A. In addition, there occurs the new problem that the contact resistance increases with the repetition of switching. There is also the problem that the increase of the contact resistance causes Joule loss during energization. As the magnetic flux density of a magnetic field is increased, the life of the switching device is extended to some extent, but increases in the size and cost of the magnetic unit cannot be avoided. As a result, it has not yet been possible to achieve reductions in the size and cost of the switching device.

The invention has been made in view of the above-mentioned problems, and provides the switching device having a contact construction which, even in the case of a high-capacitance load, can be repeatedly cut off for a long term without causing any problems such as cut-off failure, locking and deposition due to an abnormal continuation of an arc between the contacts, burning and destruction of the contacts, and an increase in contact resistance, and whose reductions in size and cost can be achieved. The invention also provides a switching device having the above-mentioned contact construction.

The invention provides, therefore, a contact construction for DC loads which includes: a stationary contact and a movable contact that are opposite to each other; and a magnetic unit which applies a magnetic field acting in a direction orthogonal to a moving direction of the movable contact, to a space in which both contacts exist, and one of the stationary contact and the movable contact is used as an anode-side contact, and the other is used as a cathode-side contact. In the contact construction for DC loads, the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO. The invention also provides a switching device having the above-mentioned contact construction.

The term "Ag-xM" used herein means an alloy which is made of Ag and M and in which the M content is x wt. % of the total weight of the alloy. For example, the term "Ag-12.2CuO" means an alloy which is made of Ag and CuO and in which the CuO content is 12.2 wt. % of the total weight of the alloy. The term "Ag-8.2$SnO_2$-5.8$In_2O_3$" means an alloy which is made of Ag, $SnO_2$ and $In_2O_3$ and in which the $SnO_2$ content and the $In_2O_3$ content are 8.2 wt. % and 5.8 wt. % of the total weight of the alloy, respectively.

BRIEF DESCRIPTION OF THE DRAWINGS

The invention will become more readily appreciated and understood from the following detailed description of preferred embodiments of the invention when taken in conjunction with the accompanying drawings, in which.

DETAILED DESCRIPTION OF THE INVENTION

A contact construction for DC loads according to the invention has a switching function capable of opening and closing an electrical circuit to which a direct current load is applied, and constitutes part of a switching device for DC loads such as a relay or a switch. The contact construction will be described below in detail with reference to the accompanying drawings.

Figure 1A:
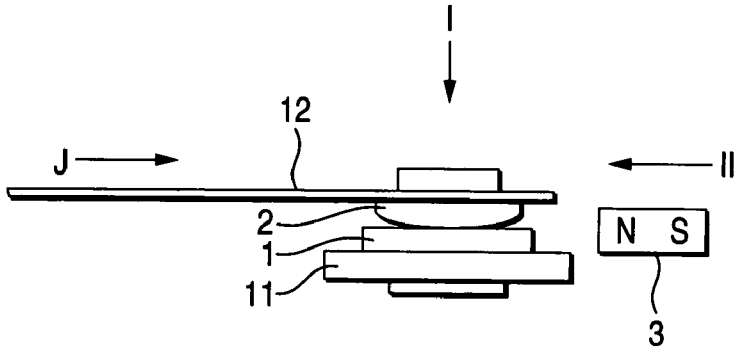
FIG. 1A is a schematic structure view of one example of a contact construction according to the invention.
Figure 1B:
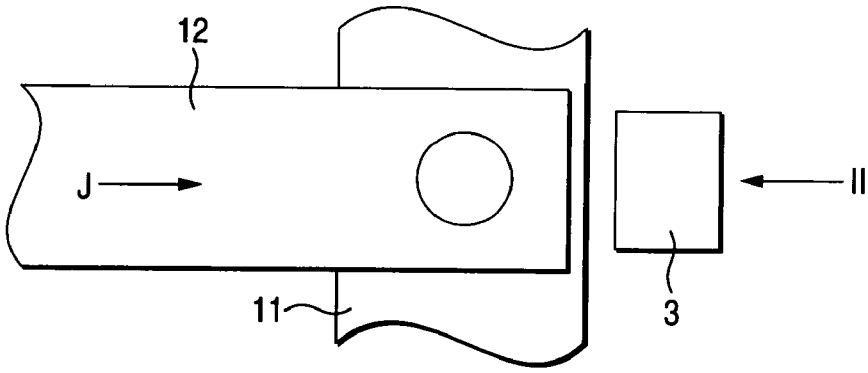
FIG. 1B is a schematic view of the contact construction seen in the direction I in FIG. 1A.
Figure 1C:
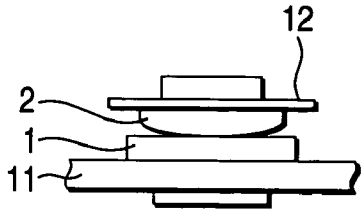
FIG. 1C is a schematic view of the contact construction seen in the direction II in FIG. 1A.

The contact construction for DC loads according to the invention includes, as shown in FIG. 1A, a stationary contact 1 and a movable contact 2 which are opposite to each other, as well as a magnetic unit 3 which applies a magnetic field acting in a direction II orthogonal to a moving direction I of the movable contact 2, to a space in which both contacts 1 and 2 exist (particularly, to a space in which both contacts 1 and 2 are released from each other). FIG. 1A is a schematic structure view of the contact construction for DC loads according to the invention, FIG. 1B is a schematic view of the contact construction seen in the direction I in FIG. 1A, and FIG. 1C is a schematic view of the contact construction seen in the direction II in FIG. 1A with the magnetic unit 3 omitted. In the following description, as occasion demands, FIGS. 1A to 1C are collectively referred to simply as FIG. 1.

In the contact construction according to the invention, one of the stationary contact 1 and the movable contact 2 is used as an anode-side contact, while the other is used as a cathode-side contact, and generally, the stationary contact 1 is used as an anode-side contact and the movable contact 2 is used as a cathode-side contact. As shown in FIG. 1, the stationary contact 1 and the movable contact 2 are generally used in the state of being secured to a stationary contact part 11 and a movable contact part 12, respectively, and in general, the stationary contact part 11 is greater in cross section than the movable contact part 12. Furthermore, the anode-side contact is generally heated to high temperatures owing to the impact of electrons emitted from the cathode-side contact by an arc generated during the release of the contacts. For this reason, from the point of view of more effectively achieving a longer life of the contact construction, it is preferable that the stationary contact 1 secured to the stationary contact part 11 which is greater in cross section and in heat capacity than the movable contact part 12 be used as the cathode-side contact to be heated to high temperatures. On the other hand, in the case where a material comparatively low in electrical conductivity, for example, brass, is used as a stationary contact part material so that movable-contact-side members (including the movable contact 2 and the movable contact part 12) are greater in heat capacity than stationary-contact-side members (including the stationary contact 1 and the stationary contact part 11), it is preferable to use the movable contact 2 as the anode-side contact, from the point of view of achieving a longer life of the contact construction.

When the stationary contact 1 and the movable contact 2 are to be used as the anode-side contact and the cathode-side contact, respectively, the contact construction may be connected in use so that the stationary contact 1 is coupled to the anode side of a DC power source and the movable contact 2 is coupled to the cathode side of the DC power source.

In either case where the stationary contact 1 or the movable contact 2 is used as the anode-side contact, in the invention, the anode-side contact is made of an $AgSnO_2$-based alloy, and the cathode-side contact is made of an AgNi-based alloy or an AgCuO-based alloy. Namely, in the case where the stationary contact 1 is used as the anode-side contact and the movable contact 2 is used as the cathode-side contact, the stationary contact 1 is made of an $AgSnO_2$-based alloy and the movable contact 2 is made of an AgNi-based alloy or an AgCuO-based alloy. In the case where the movable contact 2 is used as the anode-side contact and the stationary contact 1 is used as the cathode-side contact, the movable contact 2 is made of an $AgSnO_2$-based alloy, and the stationary contact 1 is made of an AgNi-based alloy or an AgCuO-based alloy. In the invention, since the above-mentioned materials of the anode-side contact and the cathode-side contact are used in combination, an abnormal continuation of an arc generated between the contacts 1 and 2 can be prevented and, in addition, the contact resistance therebetween can be decreased, even if the load capacitance is comparatively large and the magnetic flux density of an applied magnetic field is comparatively small. Accordingly, it is possible to prevent, for a long time, various problems such as cut-off failure, locking and deposition between the contacts, burning and destruction of the contacts and an increase in the contact resistance, and it is also possible to easily achieve reductions in size and in cost of the contact construction.

The $AgSnO_2$-based alloy which constitutes the anode-side contact is an alloy which contains at least Ag and $SnO_2$, preferably an $AgSnO_2In_2O_3$-based alloy which further contains $In_2O_3$. The $AgSnO_2$-based alloy may contain other elements (metals or metal oxides) as long as the objects of the invention can be achieved.

The total content of the metal oxides (for example, $SnO_2$ and $In_2O_3$) contained in the $AgSnO_2$-based alloy, particularly, the $AgSnO_2In_2O_3$-based alloy is 8–15 wt. %, preferably 12–15 wt. %, of the total weight of the $AgSnO_2$-based alloy. If the total content of the metal oxides is excessively small, the transfer-resistance characteristics of the contacts decrease. For example, the amount of transfer when the contact construction is switched by 100,000 times under load conditions similar to those of examples to be described later averages 8.1 mg for contacts made of only Ag and 2.7 mg for contacts made of an Ag-8.2$SnO_2$-5.8$In_2O_3$ alloy. On the other hand, if the total content of the metal oxides is excessively large, the alloy becomes difficult to form into contacts.

The content of $SnO_2$ in the $AgSnO_2$-based alloy, in particular the $AgSnO_2In_2O_3$-based alloy, is 6–10 wt. %, preferably 7–10 wt. %, of the total weight of the $AgSnO_2$-based alloy. If the $Sn_2O_3$ content is excessively small, the transfer-resistance characteristics of the contacts decrease. On the other hand, if the $Sn_2O_3$ content is excessively large, the contact resistance becomes unstable and the alloy becomes difficult to form into contacts.

The content of $In_2O_3$ in the $AgSnO_2In_2O_3$-based alloy in particular is 2–8 wt. %, preferably 5–7 wt. %, of the total weight of the $AgSnO_2In_2O_3$-based alloy. If the $In_2O_3$ content is excessively small, the contact resistance becomes unstable. On the other hand, if the $In_2O_3$ content is excessively large, the transfer-resistance characteristics of the contacts decrease. For example, the amount of transfer when the contact construction is switched by 100,000 times under load conditions similar to those of the examples to be described later averages 2.7 mg for contacts made of an Ag-8.2$SnO_2$-5.8$In_2O_3$ alloy and 5.6 mg for contacts made of an Ag-3.8$SnO_2$-10.2$In_2O_3$ alloy.

The AgNi-based alloy which constitutes the cathode-side contact is an alloy containing at least Ag and Ni, preferably an AgNiC-based alloy further containing C from the point of view of deposition resistance of the contacts. The AgNi-based alloy may contain other elements (metals or metal oxides) as long as the objects of the invention can be achieved.

The content of Ni in the AgNi alloy, particularly in the AgNiC-based alloy, is 8–12 wt. %, preferably 9–11 wt. %, of the total weight of the AgNi-based alloy. If the Ni content is excessively small, the transfer resistance characteristics of the contacts decrease. For example, the amount of transfer when the contact construction is switched by 100,000 times under load conditions similar to those of the examples to be described later averages 8.1 mg for contacts made of only Ag and 7.2 mg for contacts made of an Ag-10Ni-0.5C alloy. On the other hand, if the Ni content is excessively large, Ni easily condenses, and easily precipitates on the surfaces of the contacts. When this Ni undergoes a chemical change such as oxidation, the contact resistance increases (electrical resistivity—Ag: $1.63\times10^{-8}$ Ωm and NiO: $10^{11}$ Ωm).

The content of C in the AgNiC-based alloy in particular is not greater than 2 wt. %, preferably not greater than 1 wt. %, of the total weight of the AgNiC-based alloy. On the other hand, if the C content is excessively large, manufacturing becomes difficult.

Another AgCuO-based alloy which can constitute the cathode-side contact is an alloy containing at least Ag and CuO, and may also contain other elements (metals or metal oxides) as long as the objects of the invention can be achieved.

The content of CuO in the AgCuO-based alloy is 10–14 wt. %, preferably 11–13 wt. %, of the total weight of the AgCuO-based alloy. If the CuO content is excessively small, the transfer resistance characteristics of the contacts decrease. For example, the amount of transfer when the contact construction is switched by 100,000 times under load conditions similar to those of the examples to be described later averages 8.1 mg for contacts made of only Ag and 6.5 mg for contacts made of an Ag-12.2CuO alloy. On the other hand, if the CuO content is excessively large, the alloy becomes difficult to form into contacts.

The $AgSnO_2$-based alloy and the AgCuO-based alloy may be manufactured by any known method that ensures that they can contain their individual components in the respective predetermined amounts, and can be manufactured by, for example, a powder metallurgy method or an internal oxidation method.

The AgNi-based alloy can be manufactured by the powder metallurgy method.

Materials which constitute the stationary contact part 11 and the movable contact part 12 are not particularly limitative, and it is preferable to use materials comparatively high in electrical conductivity, for example, electrolytic copper as the stationary contact part 11 and beryllium copper as the movable contact part 12.

The contact construction according to the invention further includes the magnetic unit 3. As shown in FIG. 1, the magnetic unit 3 is disposed on the downstream side of the stationary contact 1 and the movable contact 2 in an axial direction J of the movable contact part 12, but the disposition of the magnetic unit 3 is not particularly limitative as long as the magnetic unit 3 can apply a magnetic field acting in a direction orthogonal to the moving direction I of the movable contact 2, to the space in which both contacts 1 and 2 exist, particularly, to the space in which both contacts 1 and 2 are released from each other. For example, the magnetic unit 3 may be disposed near the stationary contact 1 and movable contact 2 on either of the observe and reverse sides of the sheet of FIG. 1A.

The magnetic unit 3 is not particularly limitative, and may use any material that can produce a comparatively weak magnetic field in the central portion between both contacts 1 and 2 when the contacts 1 and 2 are released from each other, for example, a comparatively weak magnetic field with a magnetic flux density of not lower than approximately 5 mT. Specific usable examples are a permanent magnet and an electromagnet. In the invention, since the magnetic unit 3 is only capable of producing a comparatively weak magnetic field as described above, the permanent magnet which is easy to miniaturize is the most useful. A preferable magnetic flux density in the central portion between the contacts 1 and 2 when both contacts 1 and 2 are released from each other is not lower than 10 mT.

Figure 2A:
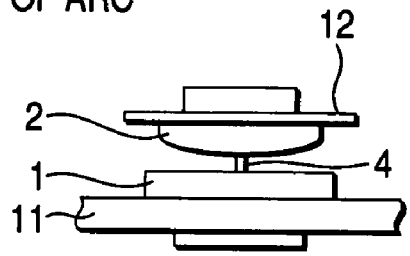
FIGS. 2A to 2C are schematic views of the contact construction which is seen in the direction II in FIG. 1, showing the flow of the process of releasing its contacts from each other.
Figure 2B:
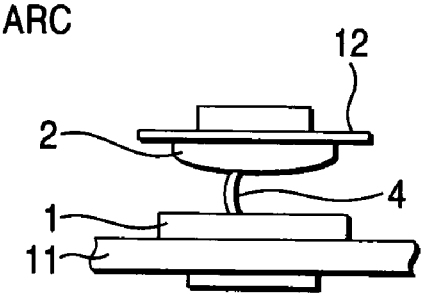
Figure 2C:
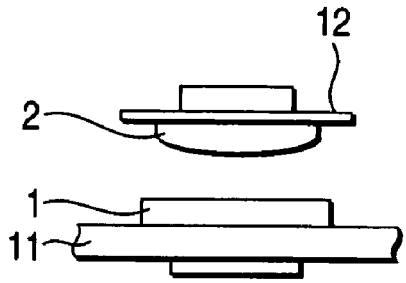

An operating mechanism for releasing the contacts 1 and 2 from each other in the above-mentioned contact construction according to the invention will be described below in brief with reference to FIG. 2. FIGS. 2A to 2C are schematic views of the contact construction according to the invention which is seen in the direction II in FIG. 1, showing the flow of the process of releasing the contacts 1 and 2 from each other. In the space between the stationary contact 1 and the movable contact 2, the above-mentioned comparatively weak magnetic field is produced in the direction from the obverse to the reverse side of the sheet of FIG. 2. In FIG. 2, the stationary contact 1 is used as an anode-side contact, while the movable contact 2 is used as a cathode-side contact. In FIG. 2, the same reference numerals as those used in FIG. 1 denote the same members as those shown in FIG. 1.

First, when the stationary contact 1 and movable contact 2 start releasing from each other (FIG. 2A), an arc 4 is produced between the stationary contact 1 and the movable contact 2. At this time, a magnetic field is produced in the space between the stationary contact 1 and the movable contact 2 in the direction from the obverse to the reverse side of FIG. 2A, and a Lorentz force acts on the arc 4. Accordingly, as the movable contact 2 is further released from the stationary contact 1 , the arc 4 curves while being significantly driven (traveling) between the contacts 1 and 2 toward the left on the sheet of FIG. 2 in accordance with the Fleming's left hand rule (FIG. 2B). After that, the arc 4 is cut, and cut-off is achieved (FIG. 2C). In the contact construction according to the invention which uses the above-mentioned materials, since the arc 4 curves while being driven between the contacts 1 and 2 by the magnetic field, the concentration of the arc 4 on the surfaces of the contacts 1 and 2 is avoided and the arc 4 is easily cut.

Accordingly, the continuation period of the arc 4 can be significantly decreased, so that the arc 4 can be effectively prevented.

In order to improve the efficiency of driving of the arc 4 by the magnetic field, it is preferable to enlarge the gap between the contacts 1 and 2 in the direction in which to magnetically drive the arc 4, as by making the periphery of each of the stationary contact 1 and the movable contact 2 thinner than the central portion of the same.

The invention also relates to a switching device. The switching device according to the invention is intended for DC loads, and may have any construction that is similar to the above-described contact construction for DC loads. The switching device may be, for examples, a relay and a switch.

In the contact construction and the switching device according to the invention, even if the release force between the movable contact and the stationary contact is set to 0.1–0.5 N and the contact force therebetween is set to a comparatively low value of 0.1–1 N, the objects of the invention can be achieved. The release force is the driving force required for the movable contact to be released from the stationary contact, and is one of initial settings which are set in advance. The contact force is the driving force required for the movable contact to be held in contact with the stationary contact, and is one of the initial settings which are set in advance.

The contact construction and the switching device according to the invention can be applied to any direct current electrical circuits for electrical and electronic devices from controls for electronic equipment of vehicles such as automobiles to heavy electrical equipment for factories, and for example it is effective in switching direct current electrical circuits under a high load condition such as of a current value of 5 to 50A, in particular 10A or more.

Embodiments

As each of embodiments 1 and 2 as well as comparative examples 1 to 9, a stationary contact and a movable contact which were made of the contact materials listed in the following table were respectively fixed to a stationary contact part and a movable contact part, and the obtained component was incorporated into a magnetic driving relay. Electrolytic copper (sectional area: 1.32 $mm^2$) and beryllium copper (sectional area: 0.45 $mm^2$) were used as the materials of the stationary contact part and the movable contact part, respectively. The dimensions of the stationary contact, the movable contact, the stationary contact part and the movable contact part and other structures of the relay were similar to those of a small-sized relay made by OMRON corporation.

(Electrical Life Test)

Each of the relays was connected so that the stationary contact and the movable contact assumed the predetermined polarities noted in the table, and was evaluated under the following conditions:

Test conditions: 42 V DC, 10 A, resistance load (switched by 100,000 times)

Magnetic flux density applied at the center of contact portion: 5 mT

Contact-to-contact gap: 1 mm

Contact force: 0.29 N

Release force: 0.15 N

In the evaluation, each of the relays was switched by 100,000 times, and the relays which did not suffer problems such as an abnormal continuation of arc between the contacts for 100 ms or more, locking and deposition as well as burning and destruction of the contacts are marked "o". In each of the relays marked "x", there occurred a problem such as cut-off failure due to abnormal continuation of an arc or a problem such as locking or deposition, or burning or destruction of the contacts.

(Contact Resistance)

The maximum values of the contact resistances of the respective relays obtained during the electrical life test are listed in the table. The contact resistances of not higher than 25 mΩ are marked "o", the contact resistances of not higher than 30 mΩ are marked "Δ", and the contact resistances of higher than 30 mΩ are marked "x". The contact resistances of not lower than "Δ" are within a range having no practical problem, and the values marked "o" are preferable.

TABLE

| | Contact material | | | |
|---|---|---|---|---|
| | Stationary contact (polarity) | Movable contact (polarity) | Electrical life test | Contact resistance (mΩ) |
| Embodiment 1 | $AgSnO_2In_2O_3$ (+) | AgNiC (−) | o | o (23.5) |
| Comparative Example 1 | $AgSnO_2In_2O_3$ (−) | AgNiC (+) | x | Δ (26.4) |
| Embodiment 2 | $AgSnO_2In_2O_3$ (+) | AgCuO (−) | o | o (21.6) |
| Comparative Example 2 | $AgSnO_2In_2O_3$ (−) | AgCuO (+) | x | Δ (29.4) |
| Comparative Example 3 | $AgSnO_2In_2O_3$ (+) | AgZnO (−) | x | x (35.3) |
| Comparative Example 4 | $AgSnO_2In_2O_3$ (−) | AgZnO (+) | x | x (33.6) |
| Comparative Example 5 | $AgSnO_2In_2O_3$ (+) | $AgSnO_2In_2O_3$ (−) | o | x (41.6) |
| Comparative Example 6 | $AgSnO_2In_2O_3$ (−) | $AgSnO_2In_2O_3$ (+) | x | x (46.4) |
| Comparative Example 7 | AgZnO (+) | AgZnO (−) | x | o (17.2) |
| Comparative Example 8 | AgNiC (+) | AgNiC (−) | x | o (16.2) |
| Comparative Example 9 | AgCuO (+) | AgCuO (−) | x | o (19.0) |

In the table, Ag-8.2$SnO_2$-5.8$In_2O_3$ was used as $AgSnO_2In_2O_3$, Ag-8ZnO was used as AgZnO, Ag-10Ni-0.5C was used as AgNiC, and Ag-12.2CuO was used as AgCuO. None of the contact materials contains any metals and metal oxides other than the listed metals and metal oxides.

The contact construction and the switching device according to the invention, even if a load capacitance is comparatively large and the magnetic flux density of an applied magnetic field is comparatively small, can be repeatedly cut off for a long term without causing any problems such as cut-off failure, locking and deposition due to an abnormal continuation of an arc between the contacts, burning and destruction of the contacts, and an increase in contact resistance. In addition, it is possible to easily achieve reductions in the size and cost of contact constructions and switching devices.

The invention claimed is:

1. A contact construction for DC loads comprising:

a stationary contact and a movable contact that are opposite to each other;

and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, and wherein the AgNi-based alloy contains 8–12 wt. % Ni.

2. A contact construction for DC loads according to claim 1, wherein the stationary contact is used as the anode-side contact and the movable contact is used as the cathode-side contact.

3. A contact construction for DC loads according to claim 1, wherein the $AgSnO_2$-based alloy used as the anode-side contact is an $AgSnO_2In_2O3$-based alloy and the AgNi-based alloy used as the cathode-side contact is an AgNiC-based alloy.

4. A contact construction for DC loads according to claim 1, wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO.

5. A contact construction for DC loads according to claim 1, wherein a permanent magnet is used as the magnetic unit for applying the magnetic field.

6. A switching device comprising the contact construction for DC loads comprising:

a stationary contact and a movable contact that are opposite to each other;

and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, and wherein the AgNi-based alloy contains 8–12 wt. % Ni.

7. A contact construction for DC loads according to claim 2, wherein the $AgSnO_2$-based alloy used as the anode-side contact is an $AgSnO_2In_2O_3$-based alloy and the AgNi-based alloy used as the cathode-side contact is an AgNiC-based alloy.

8. A contact construction for DC loads according to claim 2, wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO.

9. A contact construction for DC loads according to claim 3, wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO.

10. A contact construction for DC loads according to claim 2, wherein a permanent magnet is used as the magnetic unit for applying the magnetic field.

11. A contact construction for DC loads according to claim 3, wherein a permanent magnet is used as the magnetic unit for applying the magnetic field.

12. A contact construction for DC loads according to claim 4, wherein a permanent magnet is used as the magnetic unit for applying the magnetic field.

13. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, wherein the AgNi-based alloy contains 8–12 wt. % Ni, and wherein the stationary contact is used as the anode-side contact and the movable contact is used as the cathode-side contact.

14. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, and wherein the $AgSnO_2$-based alloy used as the anode-side contact is an $AgSnO_2In_2O_3$-based alloy and the AgNi-based alloy used as the cathode-side contact is an AgNiC-based alloy.

15. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, wherein the stationary contact is used as the anode-side contact and the movable contact is used as the cathode-side contact, and wherein the $AgSnO_2$-based alloy used as the anode-side contact is an $AgSnO_2In_2O_3$-based alloy and the AgNi-based alloy used as the cathode-side contact is an AgNiC-based alloy.

16. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, and wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO.

17. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, wherein the stationary contact is used as the anode-side contact and the movable contact is used as the cathode-side contact and wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO.

18. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, wherein the $AgSnO_2$-based alloy used as the anode-side contact is an .$AgSnO_2In_2O_3$-based alloy and the AgNi-based alloy used as the cathode-side contact is an AgNiC-based alloy, and wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO.

19. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag and CuO, wherein the stationary contact is used as the anode-side contact and the movable contact is used as the cathode-side contact, wherein the $AgSnO_2$-based alloy used as the anode-side contact is an $AgSnO_2In_2O_3$-based alloy and the AgNi-based alloy used as the cathode-side contact is an AgNiC-based alloy, and wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO.

20. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the AgNi-based alloy contains 8–12 wt. % Ni, and wherein a permanent magnet is used as the magnetic unit for applying the magnetic field.

21. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the stationary contact is used as the anode-side contact and the movable contact is used as the cathode-side contact, wherein the AgNi-based alloy contains 8–12 wt. % Ni, and wherein a permanent magnet is used as the magnetic unit for applying the magnetic field.

22. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the $AgSnO_2$-based alloy used as the anode-side contact is an $AgSnO_2In_2O_3$-based alloy and the AgNi-based alloy used as the cathode-side contact is an AgNiC-based alloy, and wherein a permanent magnet is used as the magnetic unit for applying the magnetic field.

23. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the stationary contact is used as the anode-side contact and the movable contact is used as the cathode-side contact, wherein the $AgSnO_2$-based alloy used as the anode-side contact is an $AgSnO_2In_2O_3$-based alloy and the AgNi-based alloy used as the cathode-side contact is an AgNiC-based alloy, and wherein a permanent magnet is used as the magnetic unit for applying the magnetic field.

24. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the anode-side contact is made of an $AgSnO_2In2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO, and wherein a permanent magnet is used as the magnetic unit for applying the magnetic field.

25. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the stationary contact is used as the anode-side contact and the movable contact is used as the cathode-side contact, wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO, and wherein a permanent magnet is used as the magnetic unit for applying the magnetic field.

26. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the $AgSnO_2$-based alloy used as the anode-side contact is an $AgSnO_2In_2O_3$-based alloy and the AgNi-based alloy used as the cathode-side contact is an AgNiC-based alloy, wherein the anode-side contact is made of an $AgSnO_2In2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO, and wherein a permanent magnet is used as the magnetic unit for applying the magnetic field.

27. A switching device comprising the contact construction for DC loads comprising:

a stationary contact and a movable contact that are opposite to each other; and a magnetic unit which applies a magnetic field acting in a direction orthogonal to a moving direction of the movable contact, to a space in which both contacts exist, one of the stationary contact and the movable contact being used as an anode-side contact, and the other being used as a cathode-side contact, wherein the anode-side contact is made of an $AgSnO_2$-based alloy which contains at least Ag and $SnO_2$, and the cathode-side contact is made of one of an AgNi-based alloy which contains at least Ag and Ni and an AgCuO-based alloy which contains Ag, wherein the stationary contact is used as the anode-side contact and the movable contact is used as the cathode-side contact, wherein the $AgSnO_2$-based alloy used as the anode-side contact is an $AgSnO_2In_2O_3$-based alloy and the AgNi-based alloy used as the cathode-side contact is an AgNiC-based alloy, wherein the anode-side contact is made of an $AgSnO_2In_2O_3$-based alloy which contains a total of 8–15 wt. % of metal oxides, 6–10 wt. % $SnO_2$, and 2–8 wt. % $In_2O_3$, and the cathode-side contact is made of one of an AgNiC-based alloy which contains 8–12 wt. % Ni and not greater than 2 wt. % C and an AgCuO-based alloy which contains 10–14 wt. % CuO, and wherein a permanent magnet is used as the magnetic unit for applying the magnetic field.

* * * * *

UNITED STATES PATENT AND TRADEMARK OFFICE

CERTIFICATE OF CORRECTION

PATENT NO. : 7,012,492 B2
APPLICATION NO. : 10/853501
DATED : March 14, 2006
INVENTOR(S) : Tetsuya Mori et al.

It is certified that error appears in the above-identified patent and that said Letters Patent is hereby corrected as shown below:

In Claim 26 (line 67), Column 14, replace "$AgSnO_2In2O_3$" with --$AgSnO_2In_2O_3$--.

Signed and Sealed this

Fourth Day of July, 2006

JON W. DUDAS
*Director of the United States Patent and Trademark Office*